US006195856B1

(12) United States Patent
Kremer

(10) Patent No.: US 6,195,856 B1
(45) Date of Patent: Mar. 6, 2001

(54) METHOD AND DEVICE FOR WARPING WITH A CONE SECTIONAL WARPER

(75) Inventor: Hubert Kremer, Grefarth (DE)

(73) Assignee: Sucker-Muller-Hacoba GmbH & Co., Monchengladbach (DE)

( * ) Notice: Subject to any disclaimer, the term of this patent is extended or adjusted under 35 U.S.C. 154(b) by 0 days.

(21) Appl. No.: 09/297,590

(22) PCT Filed: Nov. 6, 1997

(86) PCT No.: PCT/EP97/06157

§ 371 Date: Jul. 2, 1999

§ 102(e) Date: Jul. 2, 1999

(87) PCT Pub. No.: WO98/21388

PCT Pub. Date: May 22, 1998

(30) Foreign Application Priority Data

Nov. 8, 1996 (DE) ..... 196 46 087

(51) Int. Cl.[7] ..... D02H 3/00
(52) U.S. Cl. ..... 28/185; 28/196; 28/199
(58) Field of Search ..... 28/185, 190, 196, 28/199, 191, 192, 194, 212

(56) References Cited

U.S. PATENT DOCUMENTS

| | | | | |
|---|---|---|---|---|
| 2,398,232 | * | 4/1946 | Lambach | 28/196 |
| 2,635,321 | * | 4/1953 | Bauer et al. | 28/196 |
| 3,429,016 | * | 2/1969 | Bailey et al. | 28/185 |
| 4,074,404 | * | 2/1978 | Schenk | 28/185 |
| 4,141,120 | * | 2/1979 | Schenk | 28/185 |
| 5,410,786 | * | 5/1995 | Bogucki-Land | 28/185 |

FOREIGN PATENT DOCUMENTS

| | | |
|---|---|---|
| 2631573 | 1/1978 | (DE) . |
| 3432276 | 4/1985 | (DE) . |
| 3812045 | 1/1988 | (DE) . |
| 4304956 | 8/1994 | (DE) . |
| 0531737 | 3/1993 | (EP) . |

* cited by examiner

*Primary Examiner*—Amy B. Vanatta
(74) *Attorney, Agent, or Firm*—Pandiscio & Pandiscio

(57) ABSTRACT

Method for warping with a cone sectional warper that winds up the threads (10) in bands on a sectional warping drum (11), in which a support (12) for a thread guide comb is displaced parallel to the warping drum (11) by a forward feed drive, corresponding to the increasing thickness of the wind and predetermined warping data, with the first band being sensed during a measurement phase by a roll (15) under contact pressure and with the sensed displacement travel being recorded as a function of the number of rotations of the warping drum (11), and with the roll being drawn back and pressing on the wind lap after the measurement phase upon further winding in accordance with a mean value obtained during the measurement phase.

Figure 1:
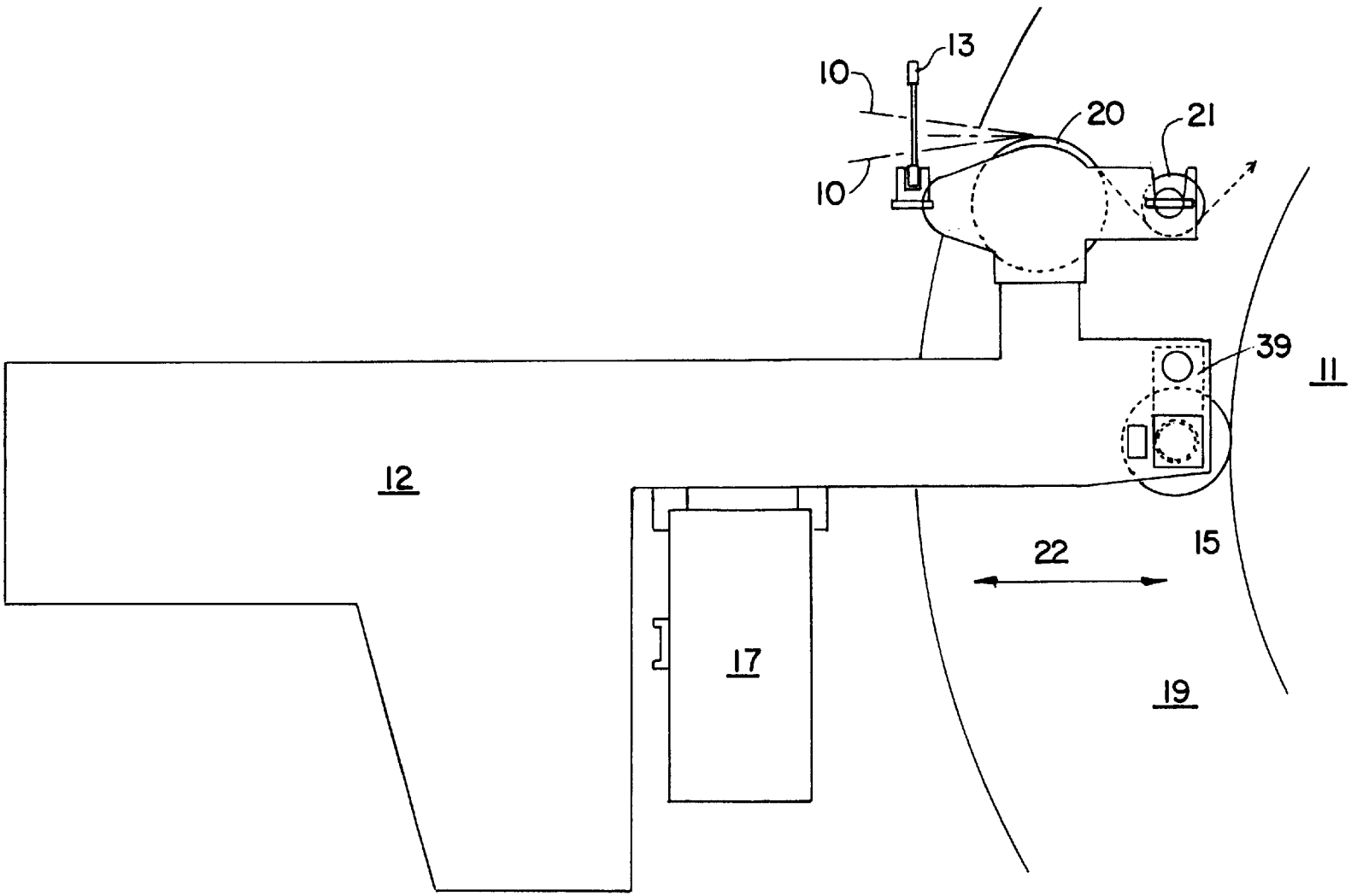

In order to even out the formation of the wind, the pressure of the roll on the wind lap is continuously measured and monitored during the measurement phase and/or during subsequent winding or copying, and the displacement of the support is corrected in case monitoring results differ from a predetermined set value.

10 Claims, 5 Drawing Sheets

METHOD AND DEVICE FOR WARPING WITH A CONE SECTIONAL WARPER

This invention relates to a method for warping with a cone sectional warper that winds up the threads in bands on a warping drum, in which a support for a thread guide comb is displaced parallel to the warping drum by a forward feed drive, corresponding to the increasing thickness of the wind and predetermined warping data, with the first band being sensed during a measurement phase by a roll under contact pressure and with the sensed displacement travel being recorded as a function of the number of rotations of the warping drum, and with the roll being drawn back and pressing on the wind lap after the measurement phase upon further winding in accordance with a mean value obtained during the measurement phase.

In warping, a number of threads passing through the thread guide comb and guided by it are wound in bands on the warping drum that has a supporting cone. The first band of threads is wound up with a parallelogram cross section determined by the cone of the drum. The second band is then likewise wound up with a parallelogram cross section using the supporting action of the first band. Corresponding processes are repeated for the following bands of threads until the entire thread warp is wound up. The buildup of all of the bands of threads depends strongly on the properties of the threads to be wound up, for example on their capillarity, coloring, twist, spinning method, etc. Hard or soft wind laps are produced during the winding. For example, if the first band has too soft a wind structure, then the second band is worked into the flank of the first band, and consequently it does not grow high enough. Its warp length is shorter than that of the first band. If the wind lap structure of the first band is too hard, the second band becomes higher since the space for the second band has become smaller because of the swelling out of the first band. The warp length is then larger than that of the first band. Either of these leads to uneven distorted and patterned fabrics that accordingly are defective.

DE 26 31 573 C3 discloses a method with the process steps mentioned initially, in which the measurement made under pressure is accomplished during the measurement phase. The first band is then to be copied under the same pressure and all of the other bands are to be copied under pressure.

DE 34 32 276 A1 discloses a warping method in which a forward feed drive is controlled by a theoretically computed feed input to a processor. At the beginning of the first warp band, a measurement phase is completed, after which the wind lap formed is checked and compared with respect to its target state with the data stored in the processor. If necessary the warp slide length and the program stored in the processor are corrected, and if needed also with a second measurement phase. The first band is then warped completely and the forward feed motions during the warping of all of the following bands are then controlled as a function of those during the warping of the entire first band. Any required correction is made with the assistance of a sensor that is impacted by the roll and detects the roll position.

In both of the methods described above, there is no monitoring during the copying of the first band of whether the lap buildup is correct. Instead, the measurement phase has to be set up and performed so that error-free warps can be wound.

With this in mind, the underlying purpose of the invention is to improve a method with the features mentioned initially so that control of the lap buildup is still possible also during the copying of at least the first band.

This problem is solved by continuously monitoring by measurement the pressure of the roll on the lap during the measurement phase and/or during the further winding and/or copying and by making a correction of the support forward feed in case the monitored result differs from a predetermined set value.

Such a method makes it still possible to intervene in the buildup of the wind lap during the copying also. If the effective prevailing pressure does not correspond to the target pressure considering tolerance thresholds, then a reaction can be triggered that consists, for example, of a correction of the support forward feed. The support feed can therefore be reduced or interrupted or enlarged. This results in a reduced or increased growth of wind lap thickness, so that the wind lap buildup can still be smoothed out correctively even during the copying. Complete levelling of the pressure of the roll is possible during the entire warp buildup. As a consequence it is possible to exclude influences that cannot be detected during one measurement phase or even several measurement phases, for example the increase of thread tension from decreasing thread supply of the bobbins of the creel, or inaccurate input parameters whose deviations lead to a multiplication effect with lengthening warps.

The method described with respect to the measurement phase can be carried out so that the measurement phase is started with a set pressure chosen as a function of characteristics of the threads to be wound up. The winding process is adapted to the properties of the threads to be wound up, which are determined, for example, by the number of capillaries, the coloration, by the twist, or by the spinning process. This adaptation is important because even small deviations of this item-specific pressure setting lead to errors when taking the average that is obtained based on the recorded values of measurements during the measurement phase. Such errors can also have considerable effects because the long warp lengths bring about a corresponding multiplication effect.

However, the method described with regard to the measurement phase can also be implemented by determining a forward feed for the measurement phase whose magnitude is selected based on characteristics of the threads to be wound up. Such a determination of the forward feed that is thus calculated leads to a relative displacement of the warping drum with consideration not only of the cone angle but also additionally with consideration of the characteristics of the threads to be wound up. Such a method is particularly necessary when the pressure of the roll is to be practically zero during the measurement phase, or monitoring by measurement occurs only when copying. The use of a calculated forward feed during the measurement phase, however, can also be used as a supplement to monitoring the pressure of the roll on the wind lap during the measurement phase, with the calculated feed being modified in the measurement phase by means of the pressure sensor, so that after the measurement phase a correct forward feed again arises.

It is advantageous for the entire warp wind to carry out the method so that the correction of the support feed also occurs during the copying from bands following the first band. This causes warped bands distant from the cone also to be symmetrical with the lap buildup of the first band.

The method can be carried out so that the correction of the support forward feed occurs distributed stepwise over the turn of the drum in case of a pressure increase or decrease. This makes it possible to have corresponding control of the wind lap buildup, namely in the sense of smoothing over the circumference. For example, it is possible not to have to eliminate large pressure increases suddenly. Sudden pressure increases in the sense of pressure peaks occur, for example, in the area where the threads are hung on the cone drum. To some extent this is also the case when the hang points are embedded in the cone drum.

It may also be beneficial to carry out the method in such a way that brief pressure changes occurring during the measurement phase and/or during the copying are not taken into consideration when taking the average and/or when monitoring the pressure. In case of such brief pressure changes it can be assumed that no serious changes of the wind lap buildup will occur. Therefore, if pressure changes that occur do not go beyond a given length of time, no correction is made of the support forward feed. Such a method is expedient when transverse ties have to be wound in, or when the band is compressed by hanging and then has to be smoothed out.

The method can be implemented in such a way that the changes of forward feed and/or changes of support length occurring during the measurement phase, which have been detected as a function of the number of rotations of the warping drum, are copied in subsequent bands. As a consequence, changes of the wind lap buildup during the measurement phase of the first band are adopted in the beginning areas of the following bands corresponding to the measurement phase of the first band, so that there is uniformity of the wind lap buildup here in each case.

It may be advantageous to implement the method in such a way that the first band is wound with constant thread tension, and during copying starting with the second band, there is control of the thread tension of the wound threads instead of or in supplement to a correction of the support forward feed. Changes of thread tension help to avoid forward feed corrections. They can replace them completely if pressure changes from the roll are unwanted.

The invention also relates to a cone sectional warper with a support carrying a thread guide comb, that can be displaced parallel to a warping drum on a machine frame, with a motorized forward feed drive controllable through a controller to produce relative motions between the warping drum and the support corresponding to the growth of wind lap thickness, with a roll sensing the wind lap circumference with pressure, the displacement travel of which can be stored by the controller as a function of the number of rotations of the warping drum.

To be able to carry out the method described above, the cone sectional warper is designed so that the roll is supported on at least one pressure sensor that feeds data to the controller during the measurement phase and/or during further winding and/or copying, which controls the roll in the sense of a correction in case the measured pressure differs from a predetermined setting. The roll impacted by the wind is able to feed data to a pressure sensor in a simple way, whose measurement can be interpreted by the controller. Such pressure sensors can detect both excessive pressure and insufficient pressure. To correct the pressure of the roll on the wind lap, the controller can be designed according to criteria generally familiar in control circles. It is not necessary to use special adjusting mechanisms in addition to the adjusting mechanisms that are necessary anyhow.

When the roll is mounted on a pivot arm, the pressure sensor can be used largely independently of the elastic behavior of the roll, which is beneficial for the accuracy of measurement.

The cone sectional warper can be designed so that the roll is pressed against the wind lap with a servomotor. Consequently, component parts that were needed to bring about the displacement of the roll as a function of the forward feed drive of the support can be omitted. For example, gearing, couplings, and spindle components are omitted. The servomotor installed in the support becomes active when the measured pressure of the regulating roll differs from the preset pressure. The servomotor displaces the support parallel to the axis, for example, when the pressure is too high. At the same time the support is displaced perpendicular to the warping drum axis by a translation corresponding to the slope of the cone.

Figure 2B:
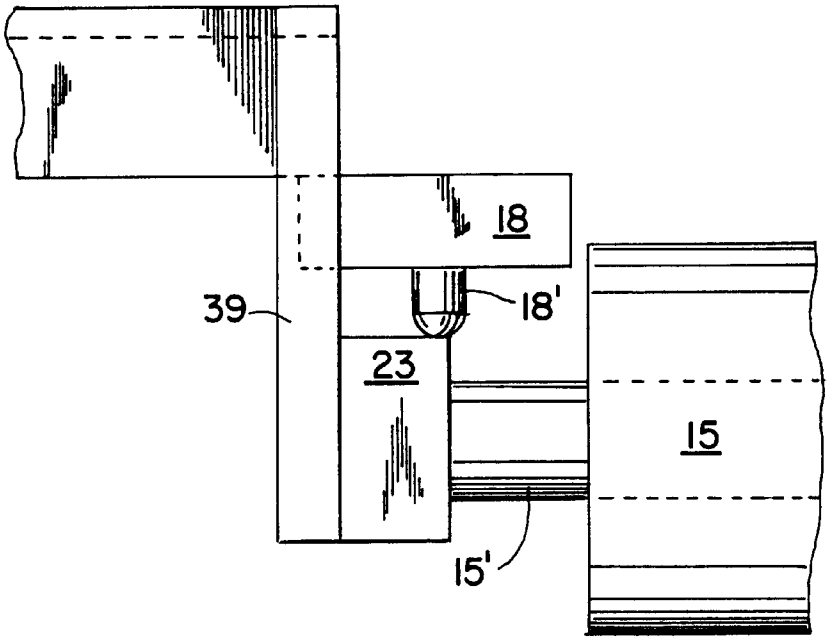
Figure 2A:
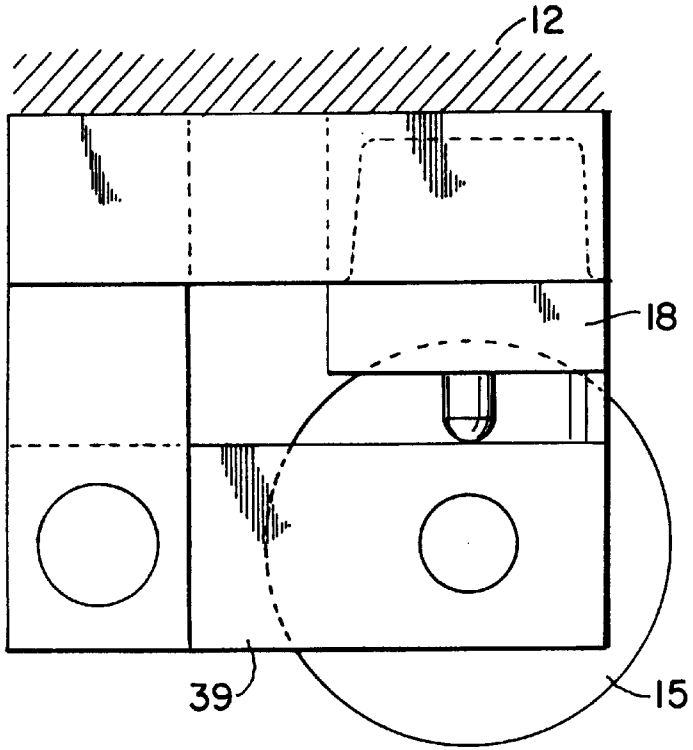

The invention will be described with reference to an example of embodiment illustrated in the drawing. The drawing shows:

FIG. 1 a schematic side view of the cone sectional warper in the area of its support, FIG. 2*a* an enlarged side view in the area of the roll, FIG. 2*b* a view rotated by 90 degrees from FIG. 2*a,*

Figure 3:
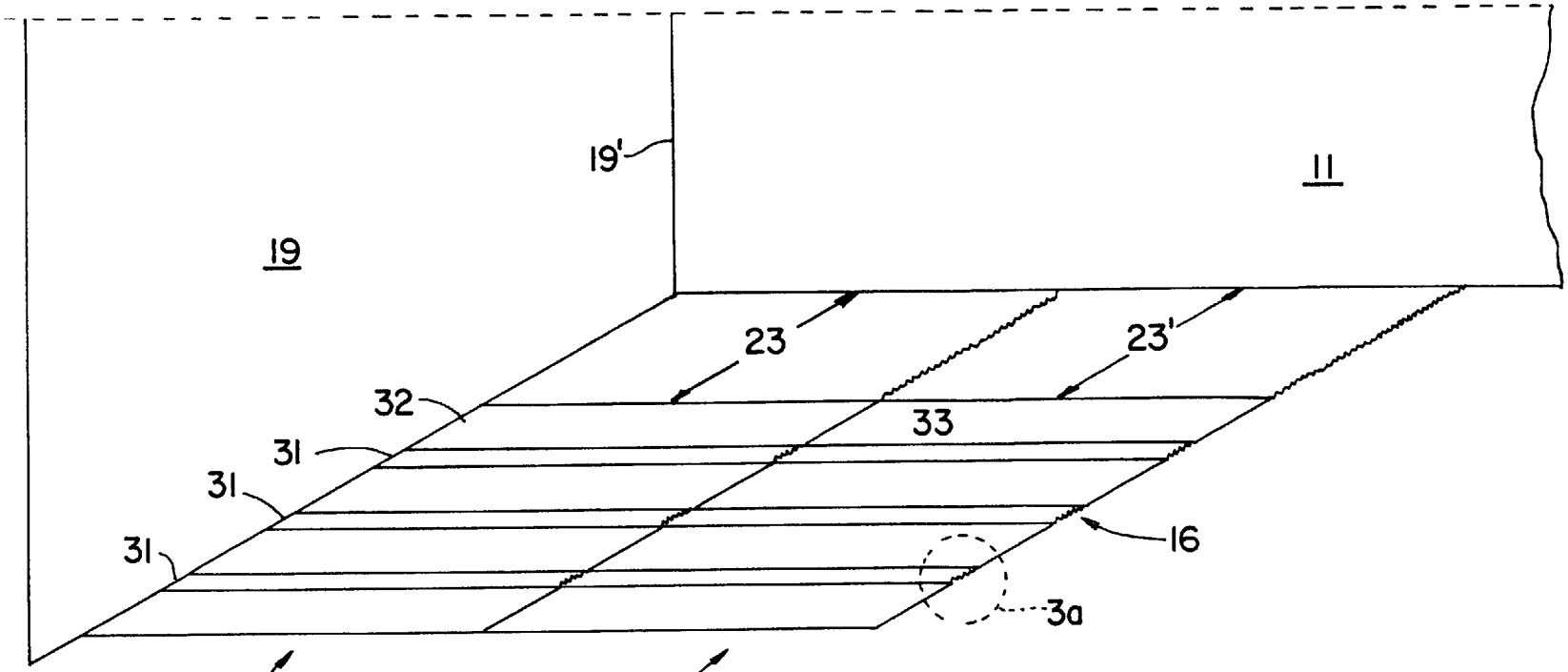
Figure 3A:
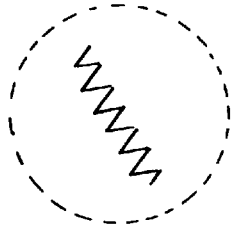

FIG. 3 a schematic partial view of two bands wound on a warping drum,

FIG. 3*a* an enlarged view of a portion of FIG. 3.

Figure 5:
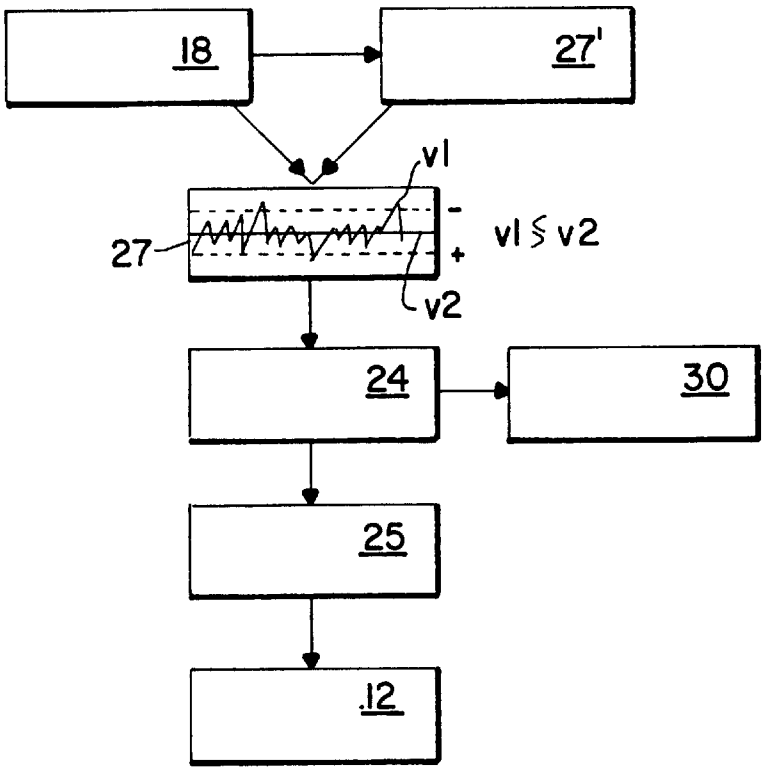
Figure 4:
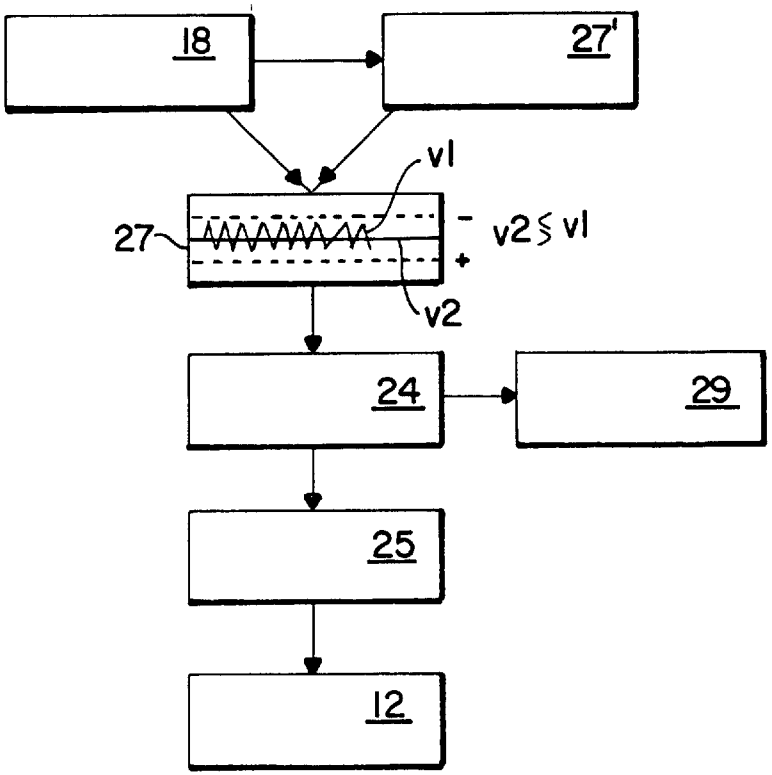
Figure 7:
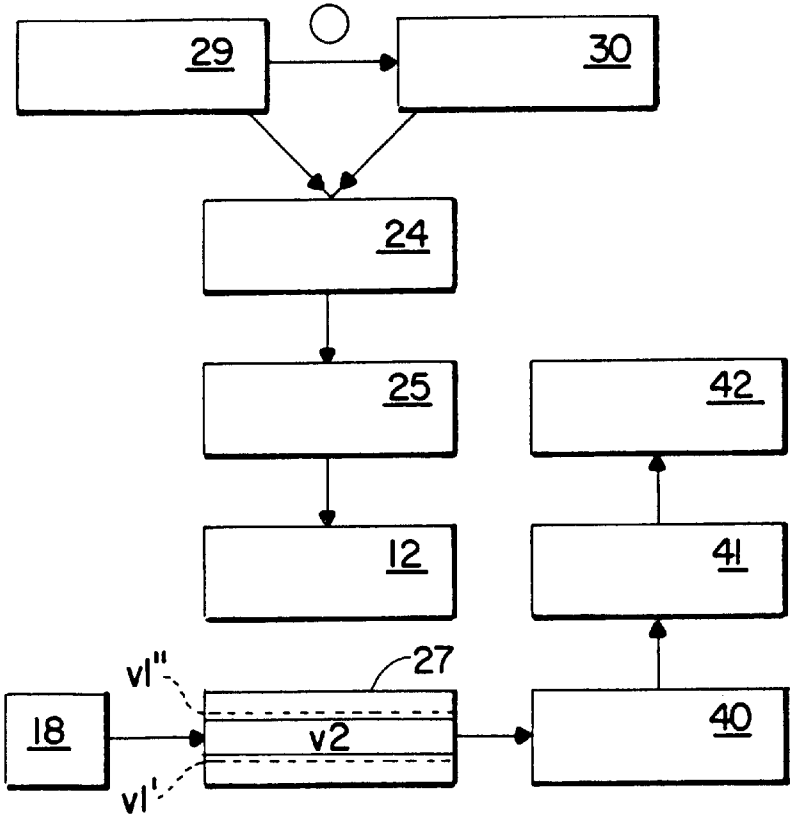
Figure 6:
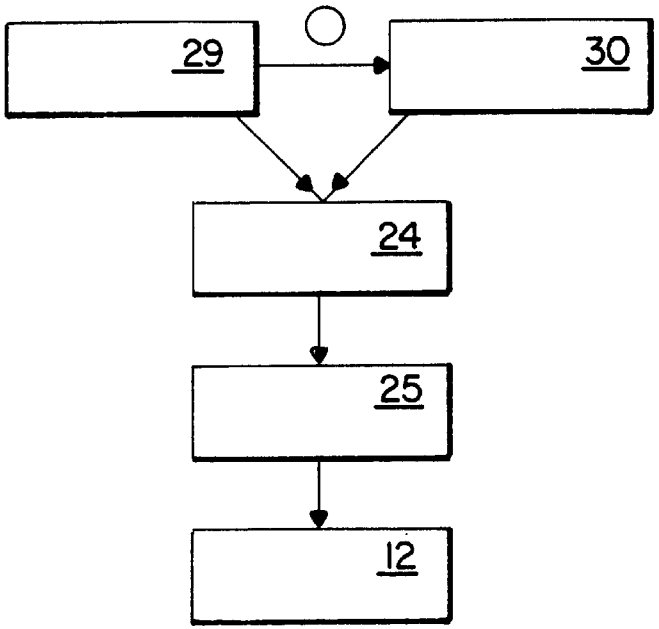

FIG. 4 a block diagram to illustrate the method during the measurement phase, FIG. 5 a block diagram to illustrate the method during the copying of the first band, FIG. 6 a block diagram to illustrate the method during the copying phase of the second and all further bands, and FIG. 7 a block diagram to illustrate the method with additional control of the wind by controlling thread tension.

A cone sectional warper has a warping drum 11 as an essential component, which can be rotated by a warping drum drive not shown. The warping drum 11 at one of its ends has a cone 19 shown in FIGS. 1 and 3, which serves to support the threads 10 wound up in bands, that are fed to the cone sectional warper from the bobbins of a bobbin creel not shown. The threads 10 form a band of threads that are arranged by a thread guide comb 13 in band width and are fed over a measuring roll 20. The measuring roll 20 is turned by the band of threads 10 so that it is possible to measure the thread length. From the measuring roll 20, the band of threads goes to the warping drum 11 while partially looped around a guide roll 21. The threads 10 of the band of threads are knotted in bundles and fastened to hangers of the drum 11, not shown. The warping drum 11 driven in rotation then draws the threads 10 off of the bobbins of the bobbin creel and winds them up.

The threads 10 are wound in bands according to FIG. 3. The threads of a band are wound on top of one another in many layers, with the bands being given a parallelogram cross section, for example the band 14. When this cross section is achieved, the first band 14 is supported by the cone 19 of the warping drum in its axial direction. To achieve the parallelogram cross section of the first band 14 shown in FIG. 3, the windup points of the threads on the warping drum 11 and on the wound thread layers have to be displaced axially. This is accomplished by appropriate relative motions between the warping drum 11 and a support 12 that carries the warp comb 13 and the measuring roll 20 and the guide roll 21. This relative motion parallel to the axis of the warping drum is the so-called support forward feed, which is produced, for example, by a forward feed drive, not shown, for example by a servomotor that is rigidly fixed to the support and meshes with a floor rail or with a toothed rail of the stationary machine frame 17, shown schematically in FIG. 1.

The support is fed forward with consideration of the cone angle and in proportion to the growing lap thickness during the winding. While the cone angle is a fixed parameter and is appropriately considered in determining the support feed, the growing lap thickness has to be detected by measurement. This is done with a regulating roll 15 that is practically as wide as the band and is mounted to rotate on the support 12. The regulating roll 15 is adjusted to the warping drum 11 at the beginning of the wind, with the beginning of the cone 19' determining the initial position or zero position. Depending on the thread specifics, the wind lap 16 builds up more or less quickly and the support feed accordingly has to be larger or smaller. If the yarn is thick, for example, the wind lap thickness increases more quickly and the forward feed and axial displacement of the regulating roll 15 have to be greater for each angular degree or for each rotation of the drum.

The regulating roll 15 can be displaced perpendicular to the axis of the drum 11 in a way not shown, and will move against the warping drum prior to beginning the wind. When the warping drum 11 is rotated, the wind lap 16 builds up in layers. At the beginning of the winding of the first band 14, a measurement phase 23 is performed that extends, for example, through 100 rotations of the warping drum 11. Therefore, the band is sensed under contact pressure during the measurement phase 23 and if the preset pressure is exceeded a motion parallel to the axis is initiated by the servomotor, and at the same time a radial motion, in small steps, until the preset pressure again prevails. After the measurement phase 23 is complete, an average is determined, ie. the average displacement travel for each rotation of the warping drum, and with it an average forward feed. The forward feed that is used during the copying subsequent to the measurement phase 23 corresponds to this.

The measurement phase 23 extends only over a relatively small wind lap thickness. For this reason it is possible that the measurement is not accurate enough and that pressure changes of the regulating roll 15 on the wind lap 16 will occur during the further windup of the first band. The result would be an incorrect wind lap buildup. It is therefore provided for the pressure of the regulating roll 15 on the wind lap 16 to be checked.

To measure the pressure of the regulating roll 15 on the wind lap 16 of the band 14, the roll is hinged to the support 12. The hinging is done with a pivot arm 39 at each end of the regulating roll 15 that permits motions relative to the support 12. Each pivot arm 39 carries one end 15' of a regulating roll shaft of the regulating roll 15 with a bearing 39'. Supported on the bearing 39' is a pressure pin 18' of a pressure sensor 18, which in turn is fixed in position on the machine frame.

Displacements of the regulating roll 15 and/or of the pivot arm 39 therefore lead to a displacement of the pressure pin 18' and consequently to a measurement by the pressure sensor 18. The pressure of the regulating roll 15 on the wind lap 16 is therefore set by the regulating roll 15 with the support 12 being pushed against the warping drum 11 until the predetermined pressure is reached. Since measurement of the pressure sensor is available continuously, it is possible to monitor it continuously and change it if needed. This can occur during the warping of the first band, for example by the support forward feed being corrected during the copying process.

The process during the measurement phase 23 is explained with reference to FIG. 4. FIG. 4 shows the pressure sensor 18 as a block that feeds its measurement to a regulator 27. The curve v1 of this pressure as a function of time is represented schematically in the regulator 27 by way of example. The pressure v1 fluctuates around an average v2 that is preset by a data store 27' of the regulator 27 as the thread-specific pressure. A tolerance zone for v2 is prescribed that is labeled in the regulator 27 by a minus sign and a plus sign. If the measured value v1 supplied by the pressure sensor 18 stays within these tolerance limits, no position change of the support is necessary. If the measurement by the pressure sensor 18 exceeds the tolerance threshold of the regulator 27, a signal is sent to the controller 24. The servomotor 25 is actuated from there, and then displaces the support 12. The pressure sensor 18 exceeds the tolerance threshold of the regulator 27 almost constantly if no forward feed is prescribed and a forward feed is determined only in the measurement phase. The controller 24 feeds data to a memory 29 for the measurement phase with the forward feed per rotation of the warping drum 11. The data on winding speed, warp length, band width, number of bands to be wound, and thread tension are also stored in the controller 24.

The process during the further winding of the first band after the measurement phase is described in FIG. 5. The regulator 27 continuously passes on the averaged forward feed from the measurement phase to the controller 24. The servomotor 25 is actuated from there, and in turn it displaces the support 12. The pressure sensor 18 continuously feeds measured values v1 to the regulator 27. When these values v1 exceed or fall below the thread-specific pressure transmitted from the data store 27' in the ± tolerance threshold, the averaged forward feed from the measurement phase is modified until v1 again falls within the tolerance thresholds of v2. The support forward feed is corrected directly through the controller 24 to the servomotor 25. The controller 24 causes the new forward feed to be stored in a memory 30 for the copying phase of the first band. Such corrections are made repeatedly if needed. FIG. 3 shows copying phases 32 in each of which forward feed changes are made to hold the roll 15 in the tolerance zone of v2 if the forward feed determined in the measurement phase 23 is not suitable.

FIG. 3 shows on the right flank of the first band 14 that this flank is not ideally smooth during the measurement phase 23. A stepwise gradation results on which the method has no effect, aside from the pressure of the regulating roll 15. The stepwise gradation arises because a pressure builds up immediately when winding is begun and the minus tolerance threshold of the regulator 27 is exceeded. In any event this is the case when no forward feed is prescribed. A copying phase 32 follows the measurement phase, during which the regulating roll 15 is withdrawn corresponding to v2 to corresponding to the average v2', not shown, obtained during the measurement phase 23, and then presses correspondingly on the wind lap 16. A finer gradation of the right flank of the first band is obtained, that has been illustrated by a straight flank section 33. If the necessity should arise in the course of further winding or copying to change the contact pressure, a correction of the support forward feed is made. Stepwise gradations again arise that are similar to those in the measurement phase and that have been illustrated enlarged as a detail A. The growth of the wind lap thickness of the entire first band 14 above the portion wound in the measurement phase 23 can be stored in the memory 30 as a function of the number of rotations of the drum.

After the copying of the first band 14, the copying of the second band 14' occurs, which is described in FIG. 6. The support forward feed is controlled by the memories 29, 30. The memory 29 controls the support forward feed in exactly the way it was recorded and stored for the measurement phase 23 of the first band. The memory 30 then takes over the control of the support forward feed through the controller 24 and the servomotor 25. Accordingly, changes of the support forward feed occur in the second band 14' in the same way as they were made in the further winding of the first band 14 after the measurement phase 23. The rest of the bands are warped correspondingly, both in accordance with the values of the pressure changes occurring in the measurement phase 23 and in accordance with the forward feed changes occurring during the copying phase of the first band in the modification phases 31.

It is definitely possible for pressure peaks to occur, especially during the measurement phase 23, with which the tolerance zone of v1 is violated. Such pressure peaks occur, for example, from inlaid partial knots or from depressions in the drum circumference that are intended for hanging thread bundles. Since these pressure peaks, positive or negative, occur only briefly, they should not contribute to a correction of the support forward feed. Therefore, they can be ignored by the controller 24 and do not reach the memory 29, for example. Therefore they are not considered during the measurement phase when determining the average and are not considered during the copying phase when monitoring the pressure.

Besides the first band 14, a second band 14' is also shown in FIG. 3. This second band 15 and any further bands are copied in accordance with the first band 14. Bands are therefore formed with wound sections 23' that are built up as in the measurement phase 23. Winding then continues like the rest of the first band after the measurement phase 23 until the complete second band 14' is finished. Pressure monitoring can also occur during the copying of the band 14' and of any other bands. Additional modification phases 31, not shown, are obtained in the second band 14' that can be adopted in the following bands.

It is desirable for the forward feed to be corrected in steps. For example a pressure increase that occurs is corrected in the following rotation of the drum in tiny steps each 10 degrees of drum rotation. The number of steps depends on the pressure increase or on the pressure decrease. Small pressure changes cause fewer steps, while larger pressure changes require many steps. The number of steps can also go beyond one drum rotation. Stepwise forward feed correction results in an especially neat buildup of the band since large jumps in the forward feed are avoided.

It has been assumed above that no forward feed is entered in the controller 24, but that the pressure building up from the beginning of the wind leads to the minus tolerance being exceeded and causing a corresponding change of forward feed in which the cone angle is also taken into consideration. However, the method can also be carried out in such a way that the controller 24 has a fixed forward feed that is already effective during the measurement phase 23. The fixed forward feed, for example, rests on experience or is calculated by determining it as a function of thread-specific data such as thread color, twist, etc.

A method is described with reference to FIG. 7 in which the copying of the second band 15 and of other bands is carried out in the way described in FIG. 6. At the same time, however, the regulator 27 is constantly fed pressure values from the pressure sensor 18. When the pressure sensor 18 supplies values v1', v1" that are outside of the ± tolerance zone of the prescribed pressure v2 and/or the average value v2', a regulating circuit 40 is supplied with data and controls the thread tension. This is done with a regulating motor 41, not shown in detail, that affects an adjusting mechanism 42, not shown in detail, to control thread tension, for example on a central adjustment of the creel brakes that brakes the wound threads less strongly when the minus tolerance threshold v1" is exceeded, and that brakes the threads more strongly when the plus tolerance threshold v1' is exceeded. With this, the sensor 18 has a direct effect on the creel thread tension.

What is claimed is:

1. A method for warping, the method comprising the steps of providing a cone sectional warper that winds up threads (10) in bands on a sectional warping drum (11), providing a support (12) for a thread guide comb (13) disposed parallel to an axis of the warping drum (11), and movable relative to the warping drum distances corresponding to an increasing thickness of wound threads and predetermined warping data, sensing a first band under contact pressure during a measurement phase and recording a sensed change of thread surface location as a function of a number of rotations of the warping drum (11), and with a regulating roll (15) being drawn back and pressing on a wind lap (16) after the measurement phase (23) upon further winding in accordance with a means value (v2') obtained during the measurement phase (23), continuously monitoring pressure of the roll (15) on the wind lap (16) during the measurement phase (23) and during further winding and continuously correcting the disposition of the support when monitoring results differ from a predetermined set value.

2. Method in accordance with claim 1, wherein the measurement phase is started with a pressure setting that is chosen as a function of characteristics of the threads (10) to be wound up.

3. Method in accordance with claim 1, wherein a forward feed is determined in the measurement phase for use in subsequent winding of threads, the magnitude of the forward feed being chosen as a function of characteristics of the threads (1) to be wound up.

4. Method in accordance with claim 1, wherein the correction of the support forward feed also occurs when copying bands follow the first band (14).

5. Method in accordance with claim 1, wherein the correction of the support forward feed is made stepwise over the drum rotation in case of a pressure increase or a pressure decrease.

6. Method in accordance with claim 1, wherein pressure changes occurring briefly during the measurement phase (23) are ignored in obtaining an average pressure and/or in monitoring the pressure.

7. Method in accordance with claim 1, wherein changes of support forward feed occurring during the measurement phase (23) that have been recorded as a function of the number of rotations of the warping drum (11) are copied in subsequent bands.

8. Method in accordance with claim 7, wherein the first band (14) is wound up with constant thread tension, and when copying a second band (15) and later bands, the thread tension of the wound threads (10) is controlled instead of or to supplement correcting the support forward feed.

9. Cone sectional warper comprising a thread guide comb (13) carried by a support (12), the support being displaceable on a machine frame (17) parallel to an axis of a warping drum (11), a motorized forward feed drive, a controller (24) for controlling said forward feed drive to produce relative motions between the warping drum (11) and the support (12) corresponding to the growth of wind lap thickness, a roll (15) for sensing wind lap circumference, displacement travel of the roll being stored by the controller as a function of the number of rotations of the warping drum (11), wherein the roll (15) is supported on at least one pressure sensor (18) that feeds data to the controller (24) during a measurement phase (23) and during further winding and copying, the controller being adapted to control the roll (15) in a corrective sense when the measured pressure differs from a predetermined set value, and wherein the roll (15) is pressed against the wind lap (16) by a servomoter.

10. Cone sectional warper in accordance with claim 9, wherein the roll (15) is mounted on a pivot arm.

* * * * *